US012595628B2

(12) United States Patent
Constantine

(10) Patent No.: US 12,595,628 B2
(45) Date of Patent: Apr. 7, 2026

(54) TRACK RAIL FASTENER STRUCTURED FOR DISPLACEMENT RESTRAINT

(71) Applicant: Progress Rail Services Corporation, Albertville, AL (US)

(72) Inventor: Edward Constantine, Belton (MO)

(73) Assignee: Progress Rail Services Corporation, Albertville, AL (US)

( * ) Notice: Subject to any disclaimer, the term of this patent is extended or adjusted under 35 U.S.C. 154(b) by 817 days.

(21) Appl. No.: 17/897,462

(22) Filed: Aug. 29, 2022

(65) Prior Publication Data

US 2024/0068172 A1 Feb. 29, 2024

(51) Int. Cl.
*E01B 9/46* (2006.01)

(52) U.S. Cl.
CPC ..... *E01B 9/46* (2013.01)

(58) Field of Classification Search
CPC ..... E01B 9/00; E01B 9/02; E01B 9/38; E01B 9/40; E01B 9/42; E01B 9/44; E01B 9/46; E01B 9/48
See application file for complete search history.

(56) References Cited

U.S. PATENT DOCUMENTS

| | | | |
|---|---|---|---|
| 5,782,406 A | 7/1998 | Igwemezie | |
| 9,004,372 B1 | 4/2015 | Alsop et al. | |
| 9,708,776 B2 | 7/2017 | Constantine et al. | |
| 2016/0298298 A1 | 10/2016 | Constantine et al. | |

FOREIGN PATENT DOCUMENTS

| | | | | |
|---|---|---|---|---|
| CN | 205839491 U | * | 12/2016 | ..... E01B 9/62 |
| CN | 106930160 B | | 2/2019 | |
| CN | 210946309 U | | 7/2020 | |
| ES | 1135135 | | 12/2014 | |
| KR | 100373436 B1 | | 4/2003 | |
| WO | 2018017220 A1 | | 1/2018 | |
| WO | 2020205417 A1 | | 10/2020 | |

OTHER PUBLICATIONS

Written Opinion and International Search Report for Int'l. Patent Appln. No. PCT/US2023/070875, mailed Oct. 23, 2023 (42 pgs).

* cited by examiner

*Primary Examiner* — Robert J McCarry, Jr.

(57) ABSTRACT

A direct fixation track rail fastener includes a rail plate having a first restraint hole and a second restraint hole upon opposite lateral sides of a rail support surface. The fastener also includes a frame including a first vertical protrusion and a second vertical protrusion received through the first restraint hole and the second restraint hole. A non-metallic cushion extends between the rail plate and the frame and vertically upward to surround the first vertical protrusion and the second vertical protrusion within the first restraint hole and the second restraint hole, respectively. The configuration assists in limiting displacement of the rail plate and frame relative to one another.

19 Claims, 3 Drawing Sheets

TRACK RAIL FASTENER STRUCTURED FOR DISPLACEMENT RESTRAINT

TECHNICAL FIELD

The present disclosure relates generally to a track rail fastener, and more particularly to a track rail fastener configured for restraining displacement between a rail plate and a frame.

BACKGROUND

Rail equipment is used throughout the world to transport persons and all manner of goods and equipment. Parallel track rails supported upon a substrate are used for trains transporting freight and/or passengers in a well-known manner. The track rails are positioned upon and fastened to a substrate using a variety of different mechanisms. Rail fastening and fixation systems include simple plates attaching rails to wooden ties, as well as highly engineered fasteners formed from an assembly of metallic and non-metallic parts attaching track rails to ties or poured concrete, for example.

The immense weight of rail equipment can subject the track rails and fasteners to severe loads and vibrations during service. Track rails and other components also tend to grow or shrink dimensionally with temperature changes. Lateral loads, longitudinal loads, and vibrational phenomena experienced by the fasteners during service can justify routine inspection, adjustment, and replacement.

In one know direct fixation fastener design, a non-metallic material is positioned between a metallic rail plate that contacts and is attached to the track rail and a metallic lower frame that is attached to the substrate. During service, the non-metallic material can be subjected to significant shear stresses, resulting in performance degradation and potentially even total failure if the rail plate and frame are caused to separate. One known direct fixation fastener strategy is known from U.S. Pat. No. 10,089,915 to Constantine.

SUMMARY

In one aspect, a track rail fastener includes a rail plate having an upward facing rail support surface extending in a fore-aft direction between a rail plate forward edge and a rail plate back edge, a rail plate lower surface, a first restraint hole upon a first lateral side of the upward facing rail support surface, and a second restraint hole upon a second lateral side of the upward facing rail support surface. The track rail fastener further includes a frame located beneath the rail plate and including a substrate facing lower surface, and a frame upper surface, a first vertical protrusion received through the first restraint hole and a second vertical protrusion received through the second restraint hole. The track rail fastener further includes a non-metallic cushion extending horizontally between the rail plate lower surface and the frame upper surface, and vertically upward, between the rail plate and each of the first vertical protrusion and the second vertical protrusion, within the first restraint hole and the second restraint hole, respectively.

In another aspect, a rail fastening system includes a rail plate having an upward facing rail support surface extending in a fore-aft direction, an outer peripheral surface, a first inner surface, and a second inner surface. The first inner surface forms a first restraint hole spaced inward of the outer peripheral surface and extending through the rail plate upon a first lateral side of the upward facing rail support surface, and a second inner surface forming a second restraint hole spaced inward of the outer peripheral surface and extending through the rail plate upon a second lateral side of the upward facing rail support surface. The rail fastening system further includes a frame having a base plate and each of a first vertical protrusion and a second vertical protrusion extending upwardly from the base plate and positioned to register with the first restraint hole and the second restraint hole, respectively.

In still another aspect, a direct fixation fastener includes a rail plate having an outer peripheral surface, a first inner surface forming a first restraint hole spaced inward of the outer peripheral surface, and a second inner surface forming a second restraint hole spaced inward of the outer peripheral surface. The direct fixation fastener further includes a frame having a substrate facing lower surface, a frame upper surface facing the rail plate, a first vertical protrusion extending through the first restraint hole, and a second vertical protrusion extending through the second restraint hole. The direct fixation fastener further includes a non-metallic cushion sandwiched between the rail plate and the frame, and surrounding the first vertical protrusion and the second vertical protrusion within the first restraint hole and the second restraint hole, respectively.

DETAILED DESCRIPTION

Figure 1:
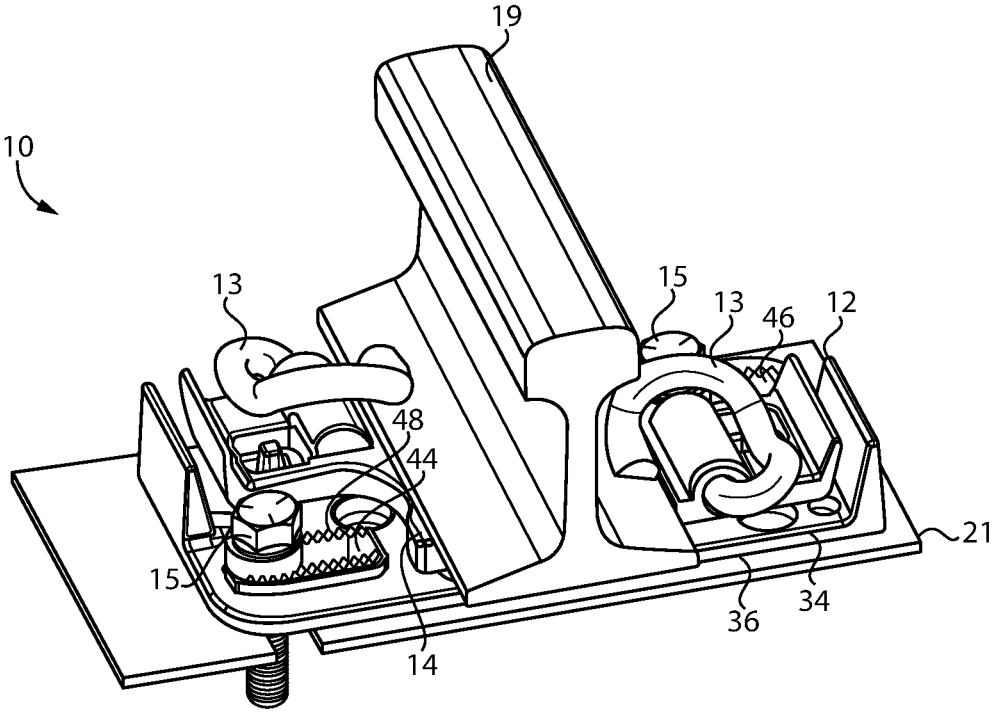
FIG. 1 is a diagrammatic view of a rail fastening system, according to one embodiment.

Referring to FIG. 1, there is shown a rail fastening system 10, according to one embodiment. System 10 includes a direct fixation track rail fastener 12 positioned upon a substrate 21 such as a concrete tie, poured concrete, or another suitable substrate. A section of track rail 19 is shown supported on fastener 12 and is attached to and clamped to fastener 12 by way of a plurality of rail clips 13. Rail clips 13 may include so-called "E-clips" in some embodiments. A plurality of substrate anchors 15 extend vertically through fastener 12 into substrate 21. Anchors 15 may include bolts extending to threaded cast-in receiving elements in substrate 21. Alternatively, anchors 15 themselves could be cast-in within substrate 21 and threaded nuts or the like coupled to free ends of cast-in anchors 15 above substrate 21.

In the illustration of FIG. 1 fastener 12 is shown including a rail plate 14 and a frame 34 located beneath rail plate 14. Each of rail plate 14 and frame 34 may include a metallic material such as an iron, steel, or various alloys, typically formed by casting. Fastener 12 will also typically include an overmolded non-metallic jacket, described hereinafter and not shown in certain of the Figures for clarity of illustration. From FIG. 1 it can be seen that frame 34 includes a first anchor hole 44 and a second anchor hole 46 extending vertically therethrough to accommodate anchors 15. Each anchor hole 44 and 46 may be associated with a plurality of teeth 48 that enable lateral, left to right in FIG. 1, positioning and adjustment of fastener 12. A fore-aft direction extends generally normal to a lateral direction, along a longitudinal length of track rail 19. As will be further apparent from the following description, system 10 and fastener 12 are uniquely configured to restrain rail plate 14 and frame 34 against displacement relative to one another, particularly against displacement of rail plate 14 in a fore-aft or longitudinal direction relative to frame 34 during service.

Figure 2:
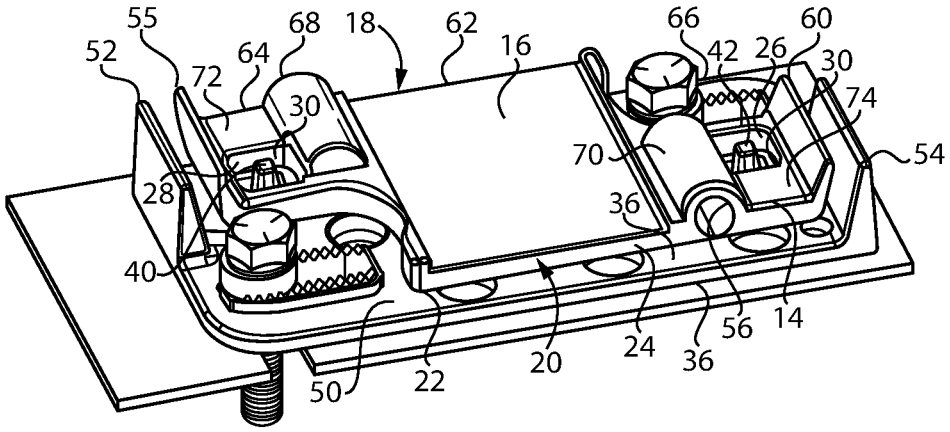
FIG. 2 is a diagrammatic view of a direct fixation track rail fastener, according to one embodiment.
Figure 6:
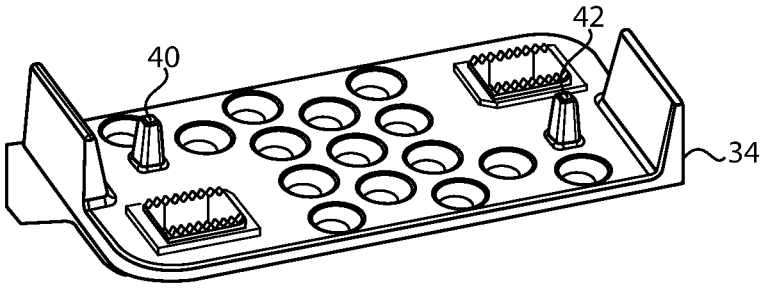
FIG. 6 is a diagrammatic view of a frame for a direct fixation track rail fastener, according to one embodiment.
Figure 7:
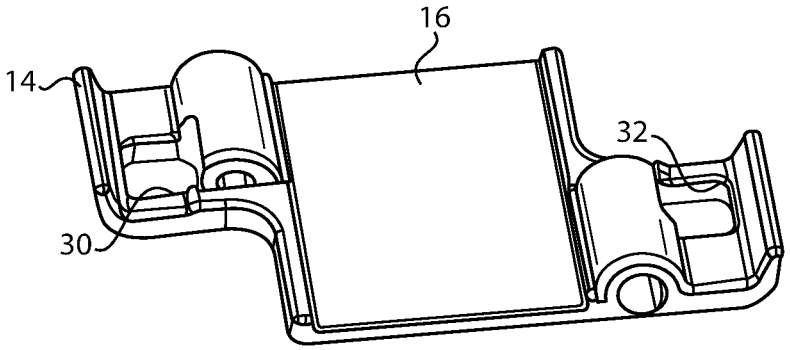
FIG. 7 is a diagrammatic view of a rail plate for a direct fixation track rail fastener, according to one embodiment.

Referring also now to FIGS. 2, 6, and 7, rail plate 14 includes an upward facing rail support surface 16 extending in the fore-aft direction between a rail plate forward edge 18 and a rail plate back edge 20. Rail plate 14 also include a rail plate lower surface 22, a first restraint hole 30 upon a first lateral side of upward facing rail support surface 16, and a second restraint hole 32 upon a second lateral side of upward facing rail support surface 16. Rail plate 14 also includes an outer peripheral surface 24, a first inner surface 26 forming first restraint hole 30, and a second inner surface 28 forming second restraint hole 32. Each of first restraint hole 30 and second restraint hole 32 extends vertically through rail plate 14 and is spaced inward of outer peripheral surface 24.

Fastener 12 further includes frame 34 located beneath rail plate 14 as noted above, including a base plate 50. Frame 34 also has a substrate facing lower surface 36, and a frame upper surface 38. Frame 34 further includes each of a first vertical protrusion 40 extending upwardly from base plate 50 and a second vertical protrusion 42 extending upwardly from base plate 50. First vertical protrusion 40 and second vertical protrusion 42 are positioned to register with first restraint hole 30 and second restraint hole 32, and as shown assembled in FIGS. 1 and 2 in fastener 12 are received through first restraint hole 30 and second restraint hole 42, respectively.

Frame 34 may further include a first side wing 52 and a second side wing 54. Rail plate 14 may further include a center section 62 that includes rail support surface 16, a left-side section 64, and a right-side section 66 each extending laterally from center section 62. Left-side section 64 may include a clip shoulder 68, a clip heel support surface 72, and side wing 58. Right-side section 66 may include a clip shoulder 70, a clip heel support surface 74, and side wing 60. Side wings 52 and 54 may generally align in the fore-aft direction with side wings 58 and 60, respectively. When fully assembled, non-metallic material in an overmolded jacket may be positioned laterally between the respective aligned side wings.

Each clip shoulder 68 and 70 may include a clip tunnel 56 that receives a central prong of a respective one of rail clips 13. First restraint hole 30 and second restraint hole 32 may be positioned laterally between rail support surface 16 and first side wing 58 and second side wing 60, respectively. First clip shoulder 68 and second clip shoulder 70 may be positioned laterally adjacent to first restraint hole 30 and second restraint hole 32, respectively. Clip heel support surface 72 and clip heel support surface 74 may be positioned forwardly adjacent to first restraint hole 30 and rearwardly adjacent to second restraint hole 32, respectively. It can also be noted that, depending upon perspective, first restraint hole 30 and first vertical protrusion 40 are longitudinally forward, and second restraint hole 32 and second vertical protrusion 42 are longitudinally rearward. First anchor hole 44 may be located rearwardly of first vertical protrusion 40 and left-side section 64, and second anchor hole 46 may be located forwardly of second vertical protrusion 42 and right-side section 66.

Figure 3:
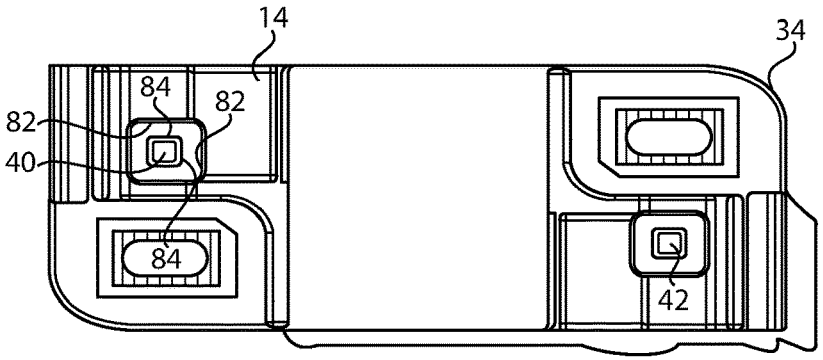
FIG. 3 is an elevational view of portions of the fastener of FIG. 2.
Figure 4:
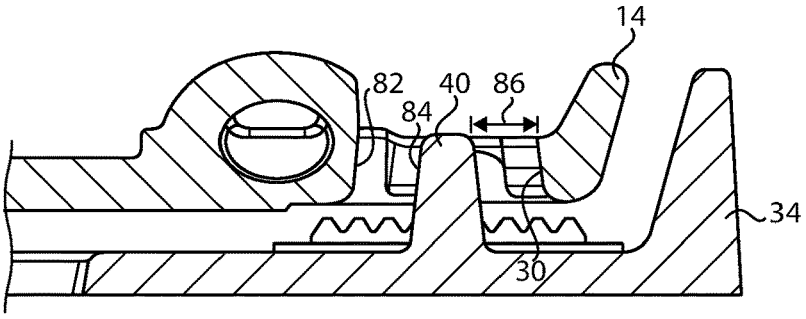
FIG. 4 is a sectioned view of portions of the fastener of FIGS. 2 and 3.
Figure 5:
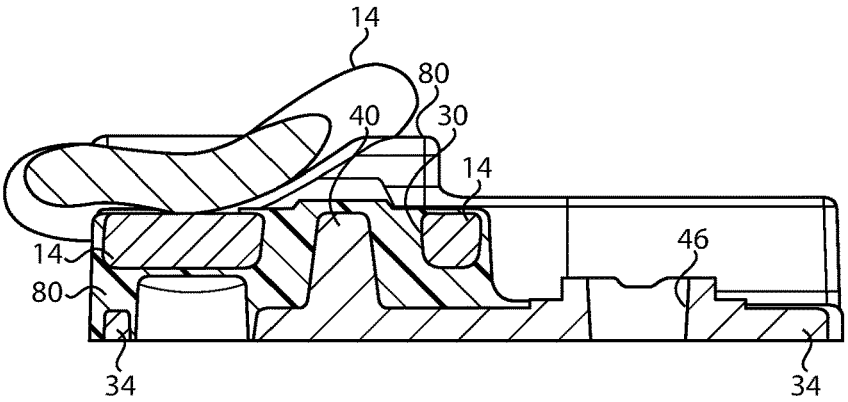
FIG. 5 is another sectioned view of portions of the fastener of FIGS. 2-4.

Referring also now to FIGS. 3, 4, and 5, a non-metallic cushion 80 extends horizontally between rail plate lower surface 22 and frame upper surface 38. Non-metallic cushion 80 also extends vertically upward, between rail plate 14 and each of first vertical protrusion 40 and second vertical protrusion 42, within first restraint hole 30 and second restraint hole 32, respectively. Non-metallic cushion 80 may include any suitable non-metallic material that can be overmolded about the metallic parts and electrically isolate rail plate 14 from frame 34. Various elastomeric materials are known and in widespread commercial use. Each of first restraint hole 30, second restraint hole 32, first vertical protrusion 40, and second vertical protrusion 42 may be encased by the overmolded jacket formed by cushion 80. Each of first anchor hole 44 and second anchor hole 46 will typically not be encased by the material of the overmolded jacket formed by non-metallic cushion 80.

As further illustrated in the drawings, it can be seen that first inner surface 26 has a plurality of restraint faces 82 forming first restraint hole 30. Second inner surface 38 is analogously configured. First vertical protrusion 40 includes a plurality of protrusion faces 84 each facing one of the respective plurality of restraint faces 86. Second vertical protrusion 42 is analogously configured. In an embodiment, each of first inner surface 26 and second inner surface 28 includes restraint faces that are finite in number, and each respective plurality of protrusion faces 84 may be matched in finite number and each oriented generally parallel to one of the respective plurality of restraint faces 82. Each respective plurality of restraint faces and each respective plurality of protrusion faces may be four in number, generally defining a quadrilateral pattern in a top view. It can also be noted from the drawings that first vertical protrusion 40 and second vertical protrusion 42 may have a frustrum shape and extends vertically upward to a location approximately vertically aligned with an upper end of the respective restrain hole 30 and 32. The frustrum shape may include a frustopyramidal shape. As shown in FIG. 4 a gap 86 extends continuously around first vertical protrusion 40 between first vertical protrusion 40 and frame 34. A second gap analogously configured extends continuously around second vertical protrusion 42 between second vertical protrusion 42 and frame 34. Non-metallic cushion 80 fills each of the respective gaps 86.

INDUSTRIAL APPLICABILITY

Referring to the drawings generally, when system 10 is installed for service track rail 19 rests upon rail support surface 16, and is clamped to rail plate 14 by way of rail clips 13 supported in clip shoulders 68 and 70. Non-metallic material of cushion 80 fills the space surrounding each respective vertical protrusion 40 and 42. Cushion 80 is also sandwiched between rail plate 14 and frame 34 and forms a continuous non-metallic layer horizontally and vertically between rail plate 14 and frame 34 that electrically isolates rail plate 14 and frame 34 from one another and transmits loads from track rail 19 to substrate 21. Cushion 80 can attenuate vibrations and limit transmission of vibrations between rail plate and frame 34.

When a load is applied to track rail 19, such as a longitudinal or fore-aft load applied by braking wheels of a locomotive or rail car upon track rail 19, the load can be transmitted from track rail 19 to rail plate 14. The placement of material of cushion 80 longitudinally between vertical protrusions 40, 42 and rail plate 14, can attenuate the load that is ultimately transferred to frame 34 held fast in substrate 21. As a result, shear forces that might otherwise be experienced by the sandwiched cushion 80 can be reduced, and resistance against failure of the non-metallic material and separation of rail plate 14 and frame 34 improved to extend service life.

The present description is for illustrative purposes only and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A track rail fastener comprising:

a rail plate including an upward facing rail support surface extending in a fore-aft direction between a rail plate forward edge and a rail plate back edge, a rail plate lower surface, a first restraint hole upon a first lateral side of the upward facing rail support surface, and a second restraint hole upon a second lateral side of the upward facing rail support surface;

a frame located beneath the rail plate and including a substrate facing lower surface, and a frame upper surface, a first vertical protrusion received through the first restraint hole and a second vertical protrusion received through the second restraint hole; and a non-metallic cushion extending horizontally between the rail plate lower surface and the frame upper surface, and vertically upward, between the rail plate and each of the first vertical protrusion and the second vertical protrusion, within the first restraint hole and the second restraint hole, respectively;

the rail plate includes a first inner surface having a plurality of restraint faces forming the first restraint hole, and a second inner surface having a plurality of restraint faces forming the second restraint hole; and each of the first vertical protrusion and the second vertical protrusion includes a plurality of protrusion faces each facing one of the respective plurality of restraint faces.

2. The track rail fastener of claim 1 wherein the rail plate includes a first side wing and a second side wing, and the first restraint hole and the second restraint hole are positioned laterally between the upward facing rail support surface and the first side wing and the second side wing, respectively.

3. The track rail fastener of claim 2 wherein the rail plate includes a first clip shoulder and a second clip shoulder positioned laterally adjacent to the first restraint hole and the second restraint hole, respectively.

4. The track rail fastener of claim 3 wherein the rail plate includes a first clip heel support surface positioned forwardly adjacent to the first restraint hole and a second clip heel support surface positioned rearwardly adjacent to the second restraint hole.

5. The track rail fastener of claim 1 wherein:

the non-metallic cushion includes an overmolded jacket electrically isolating the rail plate from the frame;

the frame includes a first anchor hole located rearwardly of the first vertical protrusion, and a second anchor hole located forwardly of the second vertical protrusion;

each of the first restraint hole, the second restraint hole, the first vertical protrusion, and the second vertical protrusion is encased by the overmolded jacket; and each of the first anchor hole and the second anchor hole is not encased by the overmolded jacket.

6. The track rail fastener of claim 1 wherein each of the first vertical protrusion and the second vertical protrusion has a frustrum shape.

7. The track rail fastener of claim 6 wherein the frustrum shape includes a frusto-pyramidal shape.

8. A rail fastening system comprising:

a rail plate including an upward facing rail support surface extending in a fore-aft direction, an outer peripheral surface, a first inner surface, and a second inner surface;

the first inner surface forming a first restraint hole spaced inward of the outer peripheral surface and extending through the rail plate upon a first lateral side of the upward facing rail support surface, and a second inner surface forming a second restraint hole spaced inward of the outer peripheral surface and extending through the rail plate upon a second lateral side of the upward facing rail support surface;

a frame including a base plate and each of a first vertical protrusion and a second vertical protrusion extending upwardly from the base plate and positioned to register with the first restraint hole and the second restraint hole, respectively; and a non-metallic cushion sandwiched between the rail plate and the frame.

9. The rail fastening system of claim 8 wherein each of the first inner surface and the second inner surface includes a plurality of restraint faces that are finite in number.

10. The rail fastening system of claim 9 wherein each of the first vertical protrusion and the second vertical protrusion includes a plurality of protrusion faces each parallel to one of the respective plurality of restraint faces.

11. The rail fastening system of claim 10 wherein each respective plurality of restraint faces and each respective plurality of protrusion faces is four in number.

12. The rail fastening system of claim 11 wherein each of the first vertical protrusion and the second vertical protrusion has a frustrum shape.

13. The rail fastening system of claim 8 wherein a first gap extends continuously around the first vertical protrusion and a second gap extends continuously around the second vertical protrusion, and the non-metallic cushion fills each of the first gap and the second gap.

14. The rail fastening system of claim 8 wherein:

the rail plate includes, upon each lateral side of the upward facing rail support surface, a clip shoulder, a side wing, and a clip heel support surface extending between the respective clip shoulder and side wing; and the first restraint hole and the second restraint hole are located laterally between the respective clip shoulder and side wing upon the respective lateral side of the upward facing rail support surface.

15. A direct fixation fastener comprising:

a rail plate including an outer peripheral surface, a first inner surface forming a first restraint hole spaced inward of the outer peripheral surface, a second inner surface forming a second restraint hole spaced inward of the outer peripheral surface, a rail plate forward edge, and a rail plate back edge;

a frame including a substrate facing lower surface, a frame upper surface facing the rail plate, a first vertical protrusion extending through the first restraint hole, a second vertical protrusion extending through the second restraint hole, and forming a first anchor hole and a second anchor hole;

a non-metallic cushion sandwiched between the rail plate and the frame, and surrounding the first vertical protrusion and the second vertical protrusion within the first restraint hole and the second restraint hole, respectively;

the rail plate including a left-side section including the first restraint hole, and a right-side section including the second restraint hole, and each of the rail plate forward edge and the rail plate back edge is formed in part upon each of the left-side section and the right-side section; and the first anchor hole and the second anchor hole are spaced in a fore-aft direction from the left-side section and the right-side section, respectively.

16. The direct fixation fastener of claim 15 wherein the first restraint hole and the first vertical protrusion are longitudinally forward, and the second restraint hole and the second vertical protrusion are longitudinally rearward.

17. The direct fixation fastener of claim 16 wherein the rail plate includes a center section including a rail support surface, the left-side section and the right-side section each extending laterally from the center section, and wherein a clip shoulder, a clip heel support surface, and a side wing, are within each of the left-side section and the right-side section.

18. The direct fixation fastener of claim 17 wherein each of the first inner surface and the second inner surface includes a plurality of restraint faces that are finite in number, and each of the first vertical protrusion and the second vertical protrusion includes a plurality of protrusion faces each parallel to one of the respective plurality of restraint faces.

19. A track rail fastener comprising:

a rail plate including an upward facing rail support surface extending in a fore-aft direction between a rail plate forward edge and a rail plate back edge, a rail plate lower surface, a first restraint hole upon a first lateral side of the upward facing rail support surface, and a second restraint hole upon a second lateral side of the upward facing rail support surface;

a frame located beneath the rail plate and including a substrate facing lower surface, and a frame upper surface, a first vertical protrusion received through the first restraint hole and a second vertical protrusion received through the second restraint hole; and a non-metallic cushion extending horizontally between the rail plate lower surface and the frame upper surface, and vertically upward, between the rail plate and each of the first vertical protrusion and the second vertical protrusion, within the first restraint hole and the second restraint hole, respectively;

the non-metallic cushion includes an overmolded jacket electrically isolating the rail plate from the frame;

the frame includes a first anchor hole located rearwardly of the first vertical protrusion, and a second anchor hole located forwardly of the second vertical protrusion;

each of the first restraint hole, the second restraint hole, the first vertical protrusion, and the second vertical protrusion is encased by the overmolded jacket; and each of the first anchor hole and the second anchor hole is not encased by the overmolded jacket.

* * * * *